United States Patent [19]

Spradlin

[11] 3,965,820

[45] June 29, 1976

[54] METHOD FOR HIGH DENSITY RECORDING OF SOURCE CREDIT TRANSACTION DATA

[76] Inventor: Erdman O. Spradlin, 360 Green Acres Drive, Naperville, Ill. 60540

[22] Filed: Mar. 31, 1975

[21] Appl. No.: 563,812

Related U.S. Application Data

[60] Continuation of Ser. No. 379,718, July 16, 1973, abandoned, which is a division of Ser. No. 132,050, April 7, 1971, Pat. No. 3,762,316.

[52] U.S. Cl. ..... 101/426; 101/45; 101/90

[51] Int. Cl.[2] ..... B41F 3/04

[58] Field of Search ..... 101/45, 90, 269–274, 101/66, 67, 426

[56] References Cited

UNITED STATES PATENTS

| | | | |
|---|---|---|---|
| 2,260,970 | 10/1941 | Elder | 101/269 X |
| 2,632,385 | 3/1953 | Degen | 101/90 |
| 2,915,965 | 12/1959 | Persak | 101/90 |
| 3,203,348 | 8/1965 | Ellis | 101/272 |
| 3,417,681 | 12/1968 | Lenelson | 101/45 X |
| 3,628,452 | 12/1971 | Shaw | 101/269 X |
| 3,678,851 | 7/1972 | Steidinger et al. | 101/269 X |
| 3,732,811 | 5/1973 | Oldenburg | 101/90 X |

*Primary Examiner*—Edgar S. Burr
*Assistant Examiner*—Edward M. Coven
*Attorney, Agent, or Firm*—Raymond P. Niro; Jerold A. Jacover

[57] ABSTRACT

A method for recording, at the point of sale, data arising from credit card transactions, makes use of a novel apparatus disclosed in a co-pending Application, entitled APPARATUS FOR RECORDING AND PROCESSING CREDIT TRANSACTION DATA, Ser. No. 132,050. More particularly, the method involves simultaneously recording credit transaction data on both a customer credit receipt and on a single line of data paper. The data paper is advanced after each sale, thereby producing a line by line description of each individual credit transaction. Since the data paper is capable of direct input to a computer, for conversion to separate customer statements, it reduces the amount of manual and machine handling of billing information.

3 Claims, 7 Drawing Figures

Fig. 5.

ORIGINAL INVOICE ---RETAIN THIS COPY FOR YOUR RECORDS

| # | PROD./SERV. |
|---|---|
| 1 | GASO. ONLY |
| 2 | GASO. & OIL |
| 3 | OIL ONLY |
| 4 | REPAIR SERV. |
| 5 | TBA |
| 6 | ROAD SERV. |
| 7 | |
| 8 | |
| 9 | |
| N | NOT INDICATED |

| | MDSE. OR SERVICE | | | | QUAN | PRICE | AMOUNT |
|---|---|---|---|---|---|---|---|
| GAS | SUPER PREM | ~~LEAD FREE~~ | REGULAR | | 12/5 | 40 | 5.00 |
| OIL | LDO | SUPER PREM | PREM | Q.S. | | | |
| | | | | | | | |
| | | | | | | | |

REVOLVING CHARGE ACCOUNT AGREEMENT

| 100 SALE NO. | DATE MO. | DAY | YEAR 85 | 89 DEALER NO | 86 # | 90 $ AMOUNT | CUSTOMER'S SIGNATURE-KEEP IN BOX | 87 ACCOUNT NO. |
|---|---|---|---|---|---|---|---|---|
| 092 | 08 | 04 | 71 | 7427613 | 1 | $ 5.00 | John Q Public 18,240 | 762 431 672 1 |

STAN'S SERVICE CHICAGO, ILL.

JOHN Q PUBLIC

AS BILLING VERIFICATION A REPRODUCTION OF THIS LINE WILL BE ON YOUR MONTHLY STATMENT 84 86 82

84 85 89 86 88 87

734528 DEALER CREDIT CARD SALES TRANSMITTAL

| SALE NO. | MO | DAY | YR | DEALER NO. | # | $ AMOUNT | CUSTOMER SIGNATURE | ACCOUNT NO. |
|---|---|---|---|---|---|---|---|---|
| 001 | 07 | 22 | 71 | 1234567 | 3 | 500 | RW Kindelp 12640 | 123 456 789 0 |
| 002 | 07 | 22 | 71 | 1234567 | 2 | 675 | J Green 12552000 | 546 789 213 7 |
| 003 | 07 | 22 | 71 | 1234567 | 1 | 450 | John Q Peller | 234 753 567 1 |
| 004 | 07 | 22 | 71 | 1234567 | 6 | 1850 | RB Z 16.250 | 767 234 732 7 |
| 005 | 07 | 22 | 71 | 1234567 | 3 | 620 | Leroy Smith | 234 567 890 1 |
| 006 | 07 | 22 | 71 | 1234567 | 2 | 900 | K Stone 8000 | 123 657 623 2 |
| 007 | 07 | 23 | 71 | 1234567 | 1 | 555 | Z Z Botong | 678 123 567 1 |
| 008 | 07 | 23 | 71 | 1234567 | 1 | 600 | Ruiz Ruiz | 234 679 345 6 |
| 092 | 08 | 04 | 71 | 7427613 | 1 | 500 | John Q Public 18,240 | 762 431 672 1 |
| 101 | | | | | | | | |
| | | | | | | | | |
| | | | | | | | | |
| | | | | | | | | |
| | | | | | | | | |
| | | | | | | | | |
| | | | | | | | | |

77

HAND PRINT TOTAL $ 11880

Fig. 6.

Fig. 7.

STATEMENT OF CREDIT CARD ACCOUNT

JOHN Q PUBLIC
1234 MAIN ST.
ANY TOWN, U.S.A.

STATEMENT DETAIL HERE 84 85 89 86 90 88 87

DETACH AND RETURN THIS SECTION WITH PAYMENT

| SALE No. | PURCHASED MO. | DAY | YR. | DEALER No. | * | $ AMOUNT | CUSTOMER'S SIGNATURE | CUSTOMER'S CREDIT CARD No. |
|---|---|---|---|---|---|---|---|---|
| 092 | 08 | 04 | 71 | 7427613 | 1 | 500 | John Q Public 18,240 | 762 431 672 1 |
| | STAN'S SERVICE CHICAGO, ILL. | | | | | | | |
| 003 | 08 | 06 | 71 | 1427367 | 2 | 850 | John Q Public 20,004 | 762 431 672 1 |
| | ANDY'S SERVICE BOSTAN MASS | | | | | | | |
| 942 | 08 | 12 | 71 | 3247681 | 1 | 700 | John Q Public 22,000 | 762 431 672 1 |
| | WINSTON'S SERVICE AURORA ILL. | | | | | | | |
| 136 | 08 | 15 | 71 | 1745241 | 1 | 800 | Nancy Public 22350 | 762 431 672 1 |
| | BILL'S SERVICE ST. LOUIS, MO. | | | | | | | |

TOTAL PURCHASE $ 28.50

102

83

METHOD FOR HIGH DENSITY RECORDING OF SOURCE CREDIT TRANSACTION DATA

CROSS-REFERENCE TO RELATED APPLICATIONS

This application is a continuation of co-pending application Ser. No. 379,718 filed on July 16, 1973 by Erdman O. Spradlin, now abandoned which itself is a division of application Ser. No. 132,050, filed Apr. 7, 1971, and now U.S. Pat. No. 3,762,316 issued on Oct. 2, 1973.

BACKGROUND OF THE INVENTION

This invention generally relates to a method for recording source credit transaction data in a form that makes such data readily usuable for subsequent processing, accounting, and billing operators.

Modern business transactions necessarily involve large volumes of credit buying. In most retail outlets, for example, hundreds or even thousands of credit transactions are carried out in a single day. In a typical credit transaction, source recording devices are used to record the customer credit card number and the dollar amount of the transaction in a format and type style suited to read on optical character recognition (OCR) equipment. The merchant then compiles and records various individual credit transactions onto summary forms. These provide identification and batch control totals to enable reconciliation and processing by the credit center.

Most credit transactions begin with the insertion of a three part data form sales receipt together with the customer's credit card into the source recording device and are followed by the input of the dollar amount of the sale. Concurrently, the dollar amount and the information obtained on the customer's credit card are recorded on the data form. Then the data form is removed from the source recording device, the amount of sale verified and the customer's signature obtained. Finally, the three part data form is separated, one part being retained by the customer as a receipt for the transaction, a second part being retained by the dealer or for departmental records and a third part being sent to a central billing office where the credit transaction data is processed, customers are billed and dealers are reimbursed or departments credited.

As a result of the rapid increase in the volume of credit transactions nationally, most central billing offices are now facing a serious problem in efficiently processing source credit transaction data. Since each transaction initiates a single data form for accounting and billing, the hundreds of thousands of data forms developed daily must be separated, categorized, kept in order, microfilmed, read into computers, balanced against department or dealer records, sorted, matched-up and sent to the customer with his monthly statement. The man power requirements for mailing, handling and ultimately processing these mass quantities of single data forms by the cumbersome techniques presently available have become oppressive.

Thus, it is one of the principle objects of this invention to provide a unique method for efficiently recording and capturing essential credit transaction data at the point of sale and simultaneously developing such data in a form sufficient to reduce the man power, bulk paper handling, accounting, processing and billing requirements of a central billing office.

It is another object of this invention to provide a unique method for preparing descriptive bills for credit customers.

It is still another object of this invention to provide a means for recording multiple credit transactions on a single log sheet, in high density form as an automatic by-product of the preparation of the customer's sales receipt.

It is still another object of this invention to provide a method for source recording wherein each log sheet and each individual transaction thereon are completely autonomous and may be read by OCR equipment and input directly to a computer without the need for separate summary forms, numerous control activities and reconciliation operations.

Finally, it is still another object of this invention to reduce the amount and cost of data processing equipment required to process the source credit transaction data.

SUMMARY OF THE INVENTION

In accordance with this invention there is provided a method for recording source credit transaction data including the steps of: (a) recording fixed and variable data from a credit transaction on at least one unit area of a roll of data paper preferably a space extending linearily thereacross; (b) simultaneously recording such data on at least one unit area of a separate customer credit receipt; and (c) advancing the roll of data paper at least one of said unit areas after each individual transaction so that a unit by unit listing of the individual credit transactions is recorded on the roll of data paper.

BRIEF DESCRIPTION OF THE DRAWINGS

This invention will be better understood by reference to the following drawings in which:

FIG. 5 is a representation of a receipt developed by the recording apparatus of this invention.

FIG. 6 is simplified representation of a log sheet developed by the data recording apparatus of this invention showing a line-by-line or unit-by-unit listing of transactions in a form suitable for automatic processing by optical character recognition equipment.

FIG. 7 is a representation of a customer credit statement which can be generated in accordance with this invention giving a customer a descriptive bill.

DETAILED DESCRIPTION OF EMBODIMENTS OF THE INVENTION

Figures 1, 2, 3, 4:
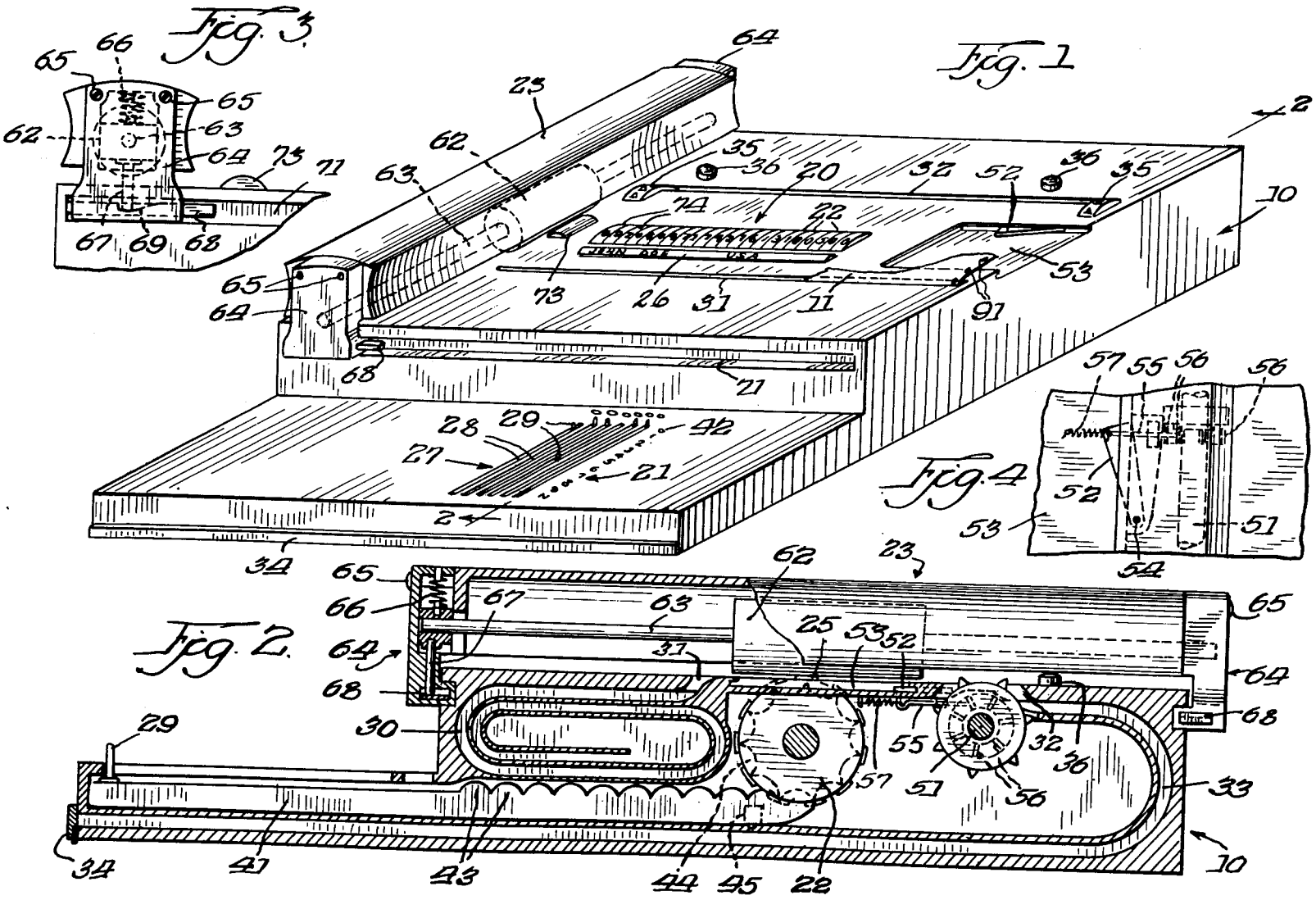
FIG. 1 is a perspective view of one form of the data recording apparatus of this invention.
FIG. 2 is a side sectional view of the data recording apparatus shown in FIG. 1.
FIG. 3 is an end view of a section of an imprint assembly for the data recording apparatus.
FIG. 4 is a fragmentary plan view of the recording apparatus showing one form of the card detent switch mechanism used to advance the data paper in the apparatus of this invention.

A transaction recording apparatus in accordance with the embodiment of the invention shown in FIGS. 1–4, generally includes: a housing 10 used to support a roll of data paper 11 and to enclose and support the internal components of the apparatus, a variable and fixed data input assembly 20 centrally mounted on housing 10, a variable data selector assembly 21 mounted on another portion of housing 10 and in direct alignment with a portion of wheels 22 in data input assembly 20, an imprint assembly 23 mounted above paper 11 and data input assembly 20 and laterally movable cross housing 10, and an advancing mechanism 52 for paper 11, which is designed to automatically advance the paper after completion of each transaction.

Housing 10 includes a rigid frame, as illustrated in FIGS. 1 and 2, which is preferably formed as a unitary structure. A cover (not shown) can also be used with the recording apparatus of this invention to protect it where necessary from inclement weather conditions.

Data paper 11 is guided along a longitudinal path extending across the top of data input assembly 20 from a position within the housing. The data paper is stored within channel 30 formed internally in the housing and advances out of opening 31 in the top of the housing, over input assembly 20 and print wheels 22, and then through opening 32 and into storage channel 33 where the completed data paper is stored. Hinged door 34 located at the bottom of housing 10 is provided to allow removal of the filled or completed data paper from storage channel. Sprockets 35 are attached to opposite ends of paper 11 and are used to advance the paper laterally across the housing from opening 31 to opening 32. Pegs 36 are mounted on housing 10 near sprockets 35 and are designed to hold the customer credit or sales receipt, shown in FIG. 5, in place when it is superimposed over the sprocket controlled data paper 11.

A series of individually settable print wheels 22 are mounted within housing 10 and extend slightly above the flat horizontal surface of the housing. Each of the print wheels has a plurality of printing elements 25 spaced about the periphery thereof. Each printing element contains a numerical character from 0 to 9 and each print wheel 22 is independently rotatable to set a preselected numeral into printing position. Print wheels 22 are coaxially mounted in adjacent relation to each other. In FIG. 1, 22 of such individual print wheels are shown, six of which are designed to input variable data from selector assembly 21 and 16 of which are designed to input both fixed and variable data manually by mechanically rotating wheels 22 with a stylus, or pencil or the like. Name plate 26 is located on housing 10 in a position adjacent input assembly 20 and can be used to input any type of fixed data that is desired, e.g. name or address of dealer, department code etc.

The means employed for rotating a portion of wheels 22 includes a control panel 27, a series of channel 28 in direct alignment with wheels 22, and a plurality of selector keys 29 slidable with channels 28 in the panel, as viewed in FIGS. 1 and 2. Each selector key 29 is operatively connected to a corresponding wheel 22 by means of shaft 41. A column of numerals 42 is inscribed on housing 10 alongside each position in channels 28 so that the described numeral on printing elements 25 can be selected by positioning the corresponding key 29 opposite the numeral on wheel 22. This is accomplished by the forward movement of shaft 41 which contains raised areas 43 that mesh with slots 44 formed on each of the wheels 22. Detent 45 applies a continuous upward pressure on shaft 41 and assures tight engagement between slots 44 and the corresponding raised areas 43. Thus as shaft 41 is moved backward and forward, individual wheels 22 are rotated and positioned to appropriate settings for data recording.

It should be observed that only six of the print wheels 22 are shown in FIGS. 1 and 2 as being directly controlled by selector assembly 21. Typically these six digits would be used in input variable data such as amount and product code. But it should be understood that any number of wheels 22 could be controlled by a larger selector assembly 21 if desired.

As previously mentioned, sprockets 35 are used to advance paper 11 after completion of each transaction. A card detent assembly such as that illustrated in FIG. 4, can be used to automatically advance paper 11 in response to the insertion and removal of an embossed credit card or the like from slot 53. Briefly, shaft 51 is used to interconnect and drive sprockets 35. Switch 52 in turn is disposed in credit card slot 53 and extends outwardly into the slot. Switch 52 is rotatable around pivot 54 and can be depressed inwardly by merely inserting a credit card into slot 53. As switch 52 is moved inwardly by a credit card it in turn drives pin 55 in the direction of shaft 51 and engages one of the nubs 56 located around the periphery of sprocket 35. This inward movement of pin 55, therfore, rotates sprockets 35 which in turn advances the roll of data paper 11. After the credit card is removed from slot 53, spring 57 pulls switch 52 back into its unrecessed or return position and the next adjacent nub 56 is in position to engage pin 55. Thus as a credit card or the like is inserted and removed from slot 53 for each transaction, paper 11 is automatically advanced to a new position and is ready for the recording of new data.

After a credit card has been inserted into slot 53, paper 11 has been advanced, data input assembly 20 has been set and receipt (FIG. 5) is placed in position above paper 11, the data recording apparatus of this invention is ready for imprinting. Imprinting is accomplished by means of slidable imprint arm 23, which is moved laterally across receipt (FIG. 5), paper 11, in a credit card and data input assembly 20. Channel 71 in housing 10 is provided for imprint arm 23 and allows it to be manually pushed across the housing. Roller 62 on shaft 63 is internally mounted and recessed within imprint arm 23. A pair of brackets 64 are mounted on opposite ends of arm 23 and are held in place by suitable fastening means, such as rivets 65.

As shown in FIG. 3, shaft 63 is adapted for vertical movement within arm 23. This is accomplished by mounting shaft 63 between spring 66 which interconnects the top portion of arm 23 with shaft 63 and lift rod 67 which engages shaft 63 at its uppermost point and sliding bar 68 at its lowermost point. Groove 69 is cut in the surface of bar 68, allowing roller 62 to attain its lowered position. Thus, as arm 23 is moved laterally along channel 71, roller 62 in its lowered position imprints data onto paper 11 and receipt (FIG. 5). When arm 23 reaches the opposite end of channel 71, moving lift rod 67 and roller 62 upwardly so that on its return movement roller 62 is in its recessed position, and double imprinting is avoided. When arm 23 reaches its return position, sliding rod 68 strikes the end of channel 71 and thus causes the lift rod to move into groove 69 and lower roller 62 to imprint position.

As shown in FIGS. 1 and 3, imprint roller 62 is designed to pass over consecutive number button 73 during the imprint cycle. Button 73 upon being depressed will automatically advance the three digit consecutive numbering head 74 in wheels 22 in order to provide a unique number for each transaction.

Naturally, one of the most striking advantages of the data recording apparatus of this invention lies in the fact that data from a number of transactions can be recorded on a line-by-line basis on a single log sheet. This, of course, greatly simplifies the processing requirements for the transaction data. Instead of one sheet of paper for each transaction, one log sheet is developed to record numerous transactions.

In addition, retail dealers or departments using the apparatus of this invention will spend less time in tabulating and recording summaries of their transactions. The volume of incoming mail to a centralizing billing operation will be reduced and thus office space and man power requirements will decrease. As shown in FIGS. 5, 6, and 7, log sheets 11, customer receipt 82 and customer statement 83 will each contain identical transaction data. Variable data, such as sales number 84 (which is set by button 73), date, 85, (which is set manually), product code 86 and amount (which are set through selector assembly 21) and credit card number 87 (which is imprinted from the customer's signature 88 and the amount of the transaction 90 can be entered on both the log sheet and receipt. Fixed data, such as a dealer code 89 (which is entered manually), name, address etc. can also be entered and recorded on both the log and receipt.

The preparation of the log sheet requires minimal effort on the part of the operator. No mechanical gadgetry is involved in loading and unloading the data log paper. The log paper 11, having one or more parts and containing sprocket control holes 91, is simply slid into the paper storage channel 31 and placed onto the sprockets 35. Thereafter, the paper is advanced automatically in a predetermined increment by inserting the customer's credit plate into slot 53. Hence, the credit transaction is executed as follows:

a. Variable data, such as the amount of sale, is entered.

b. The sales slip or credit receipt 82 bearing prepunched alignment holes, is placed over pegs 36 to register the sales slip data line 100 with the log sheet data line 101. Ply one of the sales slip is of the self-imaging chemically treated type paper. The last ply or back of the sales slip bears a carbon coated strip the length and width of the data band.

c. The imprint assembly 23 is moved across housing 10 to record identical images on the sales slip 82 and log sheet 11.

d. The sales slip 82 while still in position on the recorder, is signed by the customer. The data line on the log sheet 101 including the customer's signature, is now a carbon copy of the data line on the customer's receipt 100.

Since data lines on the log sheet contains all necessary information for accounting and billing purposes individual data forms are not needed by the credit center.

It should be noted that each log sheet and each transaction thereon are totally independent and identifiable entities capable of being processed without additional supporting data such as provided by summary forms.

This unique way of capturing data at the source, in electronic machine sensible form, inherently simplifies all accounting and processing methods. The more obvious of these advantages of course, is the simple fact that the volume of paper is significantly reduced. The log sheet method of reading and capturing data produces marked efficiencies in the way of OCR throughout and reading accuracy. Moreover, treatment and capture of the log sheet as a complete entity facilitates greater use of a computer in conjunction with the OCR equipment in reading, reconciliation and sales processing in general.

Another unique advantage in this method of processing credit sales lies in the fact that an exact facsimile 102 of the essential line of data, including the customer's signature 88, becomes supporting evidence for the customer's periodic statement 83. Once the merchant submits a log, containing several different transactions, the various lines of sales data including the customer's signature, is electronically read and stored by the computer. At billing time the sales data and customer's signature associated with each transaction is sorted in account number sequence with transactions in chronoligical order and duplicated on computer output (COM) which is produced in turn as a customer statement.

It should be understood that a number of changes and modifications can be made in the embodiments disclosed herein without departing from the spirit and scope of the invention as defined in the following claims.

I claim:

1. A method for recording data from each of a plurality of credit transactions, said data including characters comprising variable information, characters comprising fixed credit card information and customer signature information, onto a credit receipt and onto data paper successively advanceable to a plurality of linearly extending spaces, each of said linearly extending spaces having a height substantially equal to the height of said characters and being adapted to receive said data corresponding to one of said credit transactions, comprising the steps of:

a. providing adjustable recording means and setting them into correspondence with said variable information;

b. advancing a first portion of one of said linearly extending spaces of said data paper into alignment with said adjustable recording means;

c. aligning said fixed credit card information with a second portion of said one of said linearly extending spaces of said data paper;

d. providing a third portion of said one of said linearly extending spaces of said data paper adapted to receive customer signature information, said first portion, said second portion and said third portion of said data paper being aligned along said one of said linearly extending spaces;

e. moving said credit receipt into overlying relationship with said one of said linearly extending spaces of said data paper; and thereafter f. simultaneously recording said variable information and said fixed credit card information respectively onto said first portion and said second portion of said one of said linearly extending spaces of said data paper, and onto said credit receipt.

2. The method recited in claim 1 further includes the step of:

g. applying a signature to said third portion of said one of said linearly extending spaces.

3. The method recited in claim 1 wherein said credit receipt includes pressure sensitive means for reproducing data aligned with said one of said linearly extending spaces.

* * * * *